US009323280B2

(12) United States Patent
Lee

(10) Patent No.: US 9,323,280 B2
(45) Date of Patent: Apr. 26, 2016

(54) APPARATUS FOR PREVENTING AUTOMOTIVE PEDAL FROM BEING PUSHED REARWARD

(71) Applicant: SL Corporation, Daegu (KR)

(72) Inventor: Hyun Ho Lee, Gyeongsangbuk-Do (KR)

(73) Assignee: SL Corporation, Daegu (KR)

( * ) Notice: Subject to any disclaimer, the term of this patent is extended or adjusted under 35 U.S.C. 154(b) by 0 days.

(21) Appl. No.: 14/266,129

(22) Filed: Apr. 30, 2014

(65) Prior Publication Data

US 2014/0326103 A1 Nov. 6, 2014

(30) Foreign Application Priority Data

May 3, 2013 (KR) ..... 10-2013-0049999

(51) Int. Cl.
*G05G 1/30* (2008.04)
*G05G 1/327* (2008.04)

(52) U.S. Cl.
CPC ..... *G05G 1/30* (2013.01); *G05G 1/327* (2013.01); *Y10T 74/20528* (2015.01)

(58) Field of Classification Search
USPC ..... 74/512, 513, 560; 180/271
See application file for complete search history.

(56) References Cited

U.S. PATENT DOCUMENTS 6,176,340 B1 * 1/2001 Mizuma et al. ..... 180/274
2004/0020324 A1 * 2/2004 Jemmeson et al. ..... 74/512
2004/0031350 A1 * 2/2004 Williams ..... B60R 21/09 74/560
2005/0050980 A1 * 3/2005 Park ..... 74/512
2005/0056115 A1 * 3/2005 Da Silva et al. ..... 74/512
2007/0137398 A1 * 6/2007 Tokumo et al. ..... 74/512

FOREIGN PATENT DOCUMENTS

| | | | |
|---|---|---|---|
| EP | 2 322 396 | B1 | 5/2011 |
| ES | 2 378 869 | A1 | 4/2012 |
| KR | 10-0657586 | B1 | 12/2006 |
| KR | 10-0657586 | B1 | 12/2006 |
| KR | 10-2011-0080043 | A | 7/2011 |
| KR | 10-1231341 | B1 | 6/2012 |
| KR | 10-2012-0116130 | A | 10/2012 |
| WO | WO-2013/011159 | A1 | 1/2013 |

* cited by examiner

*Primary Examiner* — Vicky Johnson
(74) *Attorney, Agent, or Firm* — Mintz Levin Cohn Ferris Glovsky and Popeo, P.C.; Kongsik Kim; Carolina Säve

(57) ABSTRACT

An apparatus for preventing a vehicle pedal from being pushed rearward upon a head-on collision of the vehicle is provided. The apparatus includes a collision bracket that is fixedly installed on a dash panel and a pedal arm formed by bending a plate along a predetermined reference line to form a cavity in a lengthwise direction thereof. A rotating member is disposed at an end of the pedal arm and strikes one side of the pedal arm upon colliding with the collision bracket, to rotate in a direction toward the inside of a vehicle and to release the pedal arm. A supporting bracket rotatably supports the pedal arm and the rotating member. The rotating member includes a coupling aperture upon which the supporting bracket is hinged and a plurality of arms which are oriented in different directions with respect to the coupling aperture.

13 Claims, 13 Drawing Sheets

APPARATUS FOR PREVENTING AUTOMOTIVE PEDAL FROM BEING PUSHED REARWARD

CROSS-REFERENCE TO RELATED APPLICATION

This application claims priority from Korean Patent Application No. 10-2013-0049999 filed on May 3, 2013, the disclosure of which is incorporated herein by reference in its entirety.

TECHNICAL BACKGROUND

The present invention relates to an apparatus that prevents a vehicle pedal from being pushed rearward, and more particularly, to an apparatus for preventing a vehicle pedal from being pushed rearward that prevents the pedal of a vehicle from being pushed rearward into the vehicle upon a head-on collision of the vehicle.

RELATED ART

In general, when a driver engages a brake pedal, the brake pedal pushes a pushrod connected to a master vac positioned beyond a dash panel, by which a hydraulic pressure is generated in a master cylinder. When a collision occurs, it is normal for a driver to forcefully engage a brake pedal to rapidly reduce the speed of the vehicle. The force from the impact caused by the collision, for example, a head-on collision, is applied to the driver's foot on the brake pedal, and may thus cause severe injury to the driver's foot and to the rest of the driver's lower body. In addition, when a serious collision occurs, the dash panel is pushed toward the passenger compartment of a vehicle and the impact force is increased, and since the brake pedal is positioned adjacent to the driver's foot, the degree to which the foot and the lower body of the driver are injured may further increase.

To prevent injury to the foot and the lower leg from being injured by the brake pedal when a collision occurs, an apparatus is disclosed in which a brake pedal is released from a mounted position or is bent when a strong impact force is applied such as during a collision. However, this type of apparatus has a serious safety-related defect since the brake pedal is formed of a highly rigid metal material to improve the structural rigidity of the brake pedal, the weight of the brake pedal may be increased to the extent that the brake pedal may not be properly released from the mounted position and may thus cause injury to the driver.

Therefore, a method is needed to reduce the weight of a vehicle pedal while maintaining the rigidity of the vehicle pedal and to prevent a vehicle pedal from being pushed rearward upon a head-on vehicle collision

SUMMARY

The present invention provides an apparatus for preventing an vehicle pedal from being pushed rearward that may reduce the overall weight of a vehicle pedal by forming a cavity within a pedal arm and forming a rotating member that restrains or releases the rotation of the pedal arm, of a lightweight material such as a plastics material. In addition, the present invention provides an apparatus for preventing a vehicle pedal from being pushed rearward that may improve the rigidity of the vehicle pedal while reducing the overall weight of the vehicle pedal by providing a reinforcing member formed of a metal material in a rotating member that restrains or releases the rotation of a pedal arm to improve the rigidity of the rotating member. The present invention also provides an apparatus for preventing a vehicle pedal from being pushed rearward that may facilitate the fabrication of a rotating member that restrains or releases the rotation of a pedal arm, by forming the pedal arm wherein one end of the pedal arm firmly contacts the outer circumference of a cavity.

However, exemplary embodiments are not restricted to the one set forth herein. The above and other exemplary embodiments will become more apparent to one of ordinary skill in the art to which the present invention concept pertains by referencing the detailed description of the embodiments given below.

According to exemplary embodiments of the present invention, an apparatus for preventing an vehicle pedal from being pushed rearward, may include: a collision bracket fixedly installed on a dash panel; a pedal arm formed by bending a plate along a predetermined reference line to form a cavity in a lengthwise direction thereof; a rotating member disposed at an end of the pedal arm and configured to strike one side of the pedal arm upon colliding with the collision bracket, to rotate in a direction toward the inside of a vehicle and thus to release the pedal arm; and a supporting bracket configured to rotatably support the pedal arm and the rotating member, wherein the rotating member may include a coupling aperture upon which the supporting bracket may be hinged and a plurality of arms oriented in different directions with respect to the coupling aperture.

According to the exemplary embodiment, it may be possible to reduce the overall weight and the manufacturing cost of a vehicle pedal by forming a cavity in a pedal arm. In addition, since the overall weight of a vehicle pedal may be reduced, it may be possible to prevent the rotation of a pedal arm from being hindered by the weight of the pedal arm. Since a rotating member that restrains or releases the rotation of a pedal arm may be formed of a plastic material and a reinforcing member may be disposed in the rotating member, it may be possible to reduce the overall weight of a vehicle pedal while preventing the rigidity of the vehicle pedal from deteriorating. Furthermore, since a pedal arm may be formed to have outer circumferential end portions firmly attached together, it may be possible to facilitate the formation of a rotating member.

DETAILED DESCRIPTION

Figure 1:
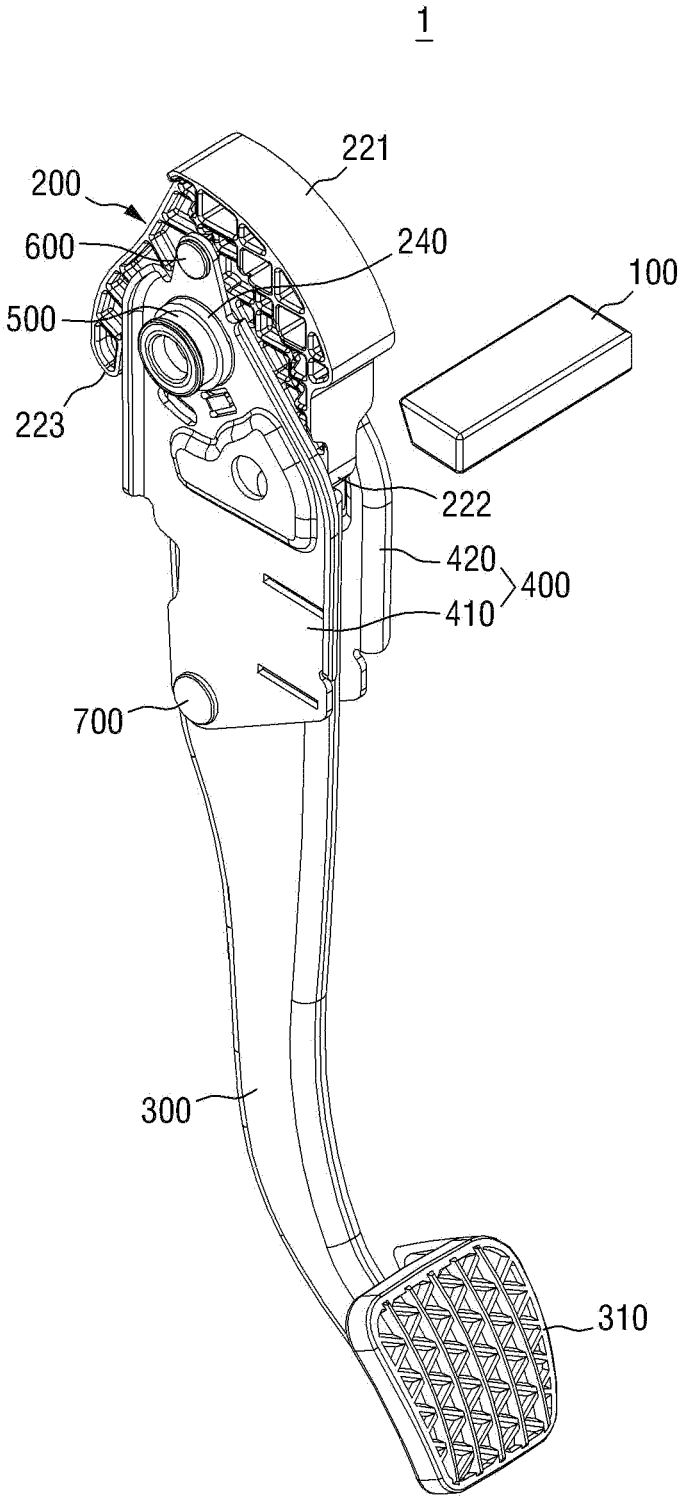
FIG. 1 is an exemplary view illustrating an apparatus for preventing a vehicle pedal from being pushed rearward, according to an exemplary embodiment.

Advantages and features of the present invention and methods of accomplishing the same may be understood more readily by reference to the following detailed description of exemplary embodiments and the accompanying drawings. The present invention may, however, be embodied in many different forms and should not be construed as being limited to the exemplary embodiments set forth herein. Rather, these exemplary embodiments are provided so that this disclosure will be thorough and complete and will fully convey the concept of the invention to those skilled in the art, and the present invention will only be defined by the accompanying claims. Like reference numerals refer to like elements throughout the specification.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Exemplary embodiments will be described with reference to perspective views, cross-sectional views, and/or plan views, in which some exemplary embodiments are shown. Thus, the profile of an example view may be modified according to manufacturing techniques and/or allowances. The exemplary embodiments are not intended to limit the scope but cover all changes and modifications that can be caused due to a change in manufacturing process. Thus, regions shown in the drawings are illustrated in schematic form and the shapes of the regions are presented simply by way of illustration and not as a limitation.

Figure 2:
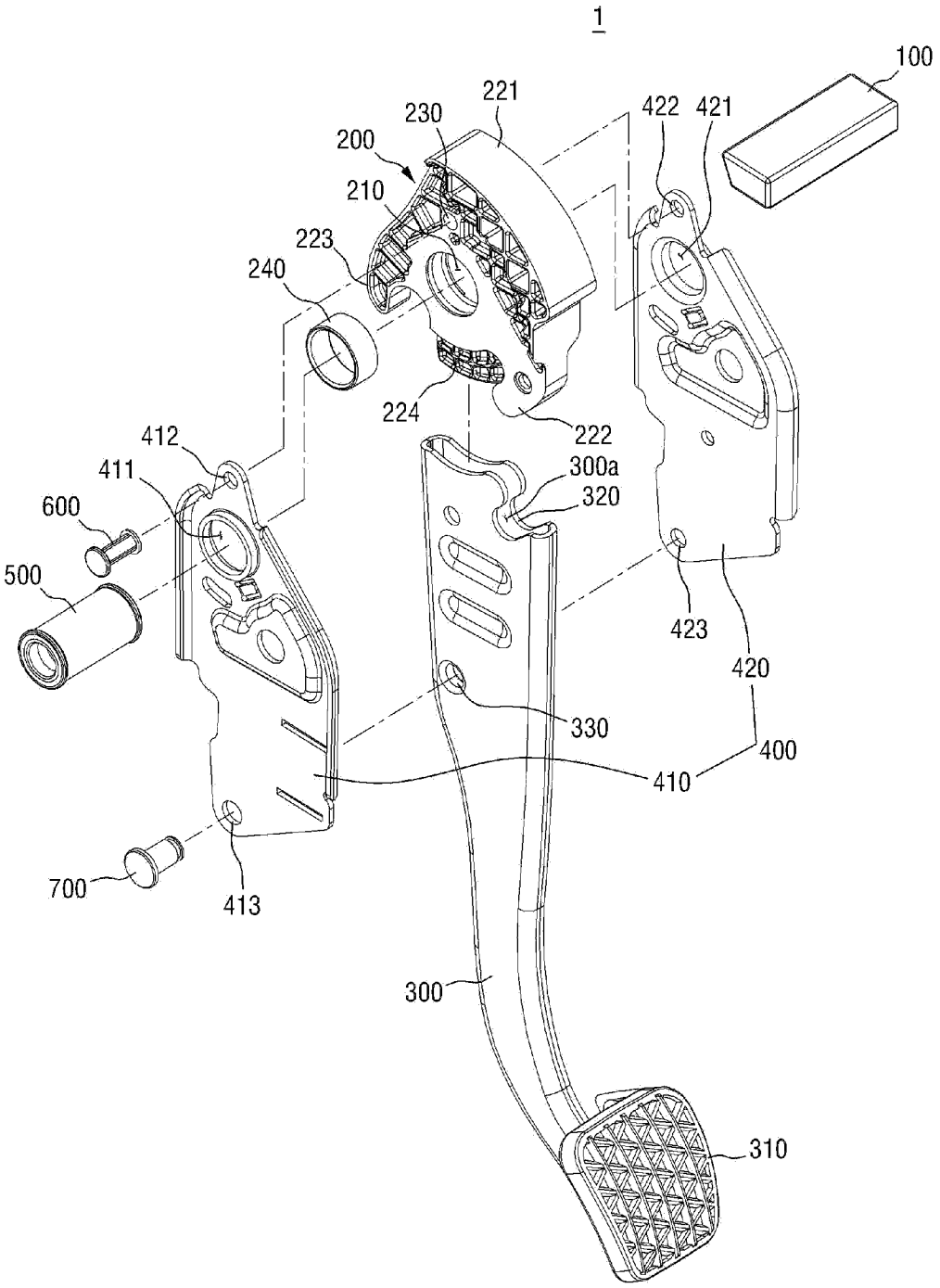
FIG. 2 is an exemplary detailed view illustrating the apparatus of FIG. 1 according to an exemplary embodiment of the present invention.
Figure 3:
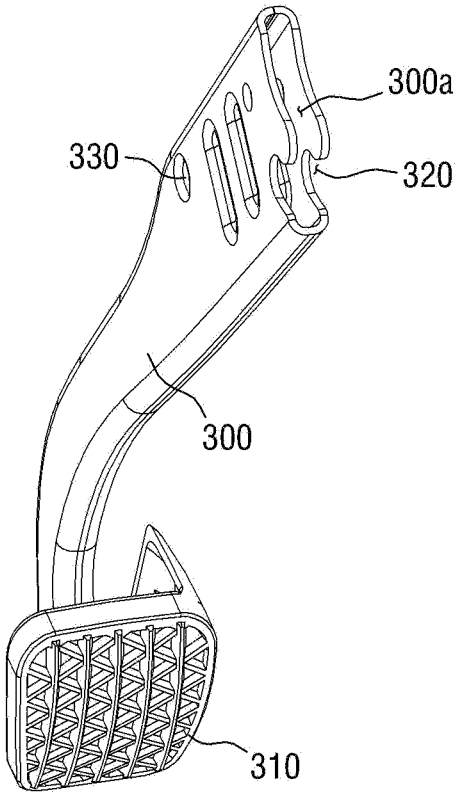
FIG. 3 is an exemplary view illustrating a pedal arm according to an exemplary embodiment.

FIG. 1 is an exemplary view illustrating an apparatus for preventing a vehicle pedal from being pushed rearward, FIG. 2 is an exemplary detailed view illustrating the apparatus of FIG. 1, and FIG. 3 is an exemplary view illustrating a pedal arm. Referring to FIGS. 1 to 3, an apparatus 1 for preventing a vehicle pedal from being pushed rearward may include a collision bracket 100, a rotating member 200, a pedal arm 300 and a supporting bracket 400. In the description that follows, it may be assumed that the apparatus 1 is for preventing a brake pedal from being pushed rearward upon a head-on vehicle collision. However, the present inventive concept may also be applied to various other vehicle pedals, such as an accelerator pedal.

The collision bracket 100 may be disposed on one side (e.g., a first side) of an upper end of the pedal arm 300 and may be a predetermined distance apart from the pedal arm 300, and a pedal pad 310, which may be pressed (e.g., engaged) by the foot of a driver, may be formed at a bottom of the pedal arm 300. In a non-limiting example, the collision bracket 100 may be disposed on one side of an upper end of a brake pedal arm and may be a predetermined distance apart from the brake pedal arm. In another non-limiting example, the collision bracket 100 may be disposed on one side of various other pedal arms such as an accelerator pedal arm. In a non-limiting example, the collision bracket 100 may be installed in a cowl panel, which may be coupled to a dash panel, but the location of the collision bracket 100 may vary depending on the layout of a vehicle.

The rotating member 200 may be disposed at the upper end of the pedal arm 300 to be rotatably supported by the supporting bracket 400. The rotation of the pedal arm 300 may be restrained or released by the rotating member 200. The supporting bracket 400 may include a first supporting bracket member 410 and a second supporting bracket member 420 which may be disposed on either side of the rotating member 200 and the pedal arm 300. The supporting bracket 400 may rotatably support the pedal arm 300 and the rotating member 200. In the exemplary embodiment of FIGS. 1 to 3, the supporting bracket 400 may include the first supporting bracket member 410 and the second supporting bracket member 420. Alternatively, the supporting bracket 400 may be provided on one side of the rotating member 200 and the pedal arm 300, or the rotating member 200 and the pedal arm 300 may be configured to be rotatably supported by separate supporting brackets.

The rotating member 200 may include a first coupling aperture 210. A pipe hinge 500, which may be inserted into a first supporting aperture 411 and a second supporting aperture 421 that may be formed on the first supporting bracket member 410 and the second supporting bracket member 420, respectively, may also be inserted into the first coupling aperture 210. As a result, the rotating member 200 may be mounted on the supporting bracket 400 to rotate in one direction. In a non-limiting example, an inner pipe 240 may be disposed on the inside of the first coupling aperture 210 to allow the rotating member 200 to be more smoothly rotatable via the pipe hinge 500. The rotating member 200 may include a plurality of first, second and third arms 221, 222 and 223 which may be oriented in different directions with respect to the first coupling aperture 210.

In response to the pedal arm 300, connected to a master vac (not illustrated) on the opposite side of a dash panel (not illustrated), being pushed rearward along with the rotating member 200 upon a head-on vehicle collision, the first arm 221 may collide with the collision bracket 100, one end (e.g., a first end) of the second arm 222 may be inserted into an insertion groove 320, formed at one end of the pedal arm 300, for example, at the upper end of the pedal arm 300, and the third arm 223, which may be formed on the opposite side (e.g., a second end) of the second arm 222 with respect to the first coupling aperture 210 to be a predetermined distance apart from the pedal arm 300, may strike one end of the pedal arm 300 and may thus allow the pedal arm 300 to rotate in response to the rotating member 200 rotating due to the collision between the first arm 221 and the collision bracket 100.

The first arm 221 may be formed in an upward direction with respect to the first coupling aperture 210, the second arm 222 may be inclined in a rear downward direction with respect to the first coupling aperture 210, and the third arm 223 may be inclined in a front downward direction with respect to the first coupling aperture 210. The terms "rear" and "front", as used herein in connection with the orientation of the second arm 222 or the third arm 223, may indicate a direction toward the inside of a vehicle and a direction toward the exterior of the vehicle, respectively.

The second arm 222 may extend from the first coupling aperture 210 at an inclination with respect to the rear downward direction, may be bent at an inclination with respect to the front downward direction, and may be inserted into the insertion groove 320 on the pedal arm 300. Since the second arm 222 may be bent into the insertion groove 320 of the pedal arm 300, the second arm 222 may be inserted in the insertion groove 320 in a direction opposite to a direction in which the upper end of the pedal arm 300 rotates in response to the pedal pad 310 being engaged by a driver, and thus, the rotation of the pedal arm 300 may be restrained until the rotating member 200 rotates to release the second arm 222 from the insertion groove 320.

A first insertion aperture 230 may be formed on the rotating member 200, and a rotation prevention member 600 may be inserted into the first insertion aperture 230 to prevent the rotation of the rotating member 200 during normal driving situations (e.g., when a collision does not occur). A second insertion aperture may be formed on at least one of the first supporting bracket member 410 and the second supporting bracket member 420. In a non-limiting example, a pair of second insertion apertures 412 and 422 may be formed on the first supporting bracket member 410 and the second supporting bracket member 420, respectively, as illustrated in FIG. 2.

In addition, the rotation prevention member 600 may be formed of a plastic material which may be breakable by an external shock. Alternatively, the rotation prevention member 600 may be formed of various other materials that are also breakable by an external shock, and the magnitude of an external shock for breaking the rotation prevention member 600 may be determined through a variety of collision experiments. In response to the pedal arm 300, connected to the master vac on the opposite side of the dash panel, being pushed rearward along with the rotating member 200 upon a head-on vehicle collision, the first arm 221 may collide with the collision bracket 100, and the rotation prevention member 600 may be broken by the impact of the collision between the first arm 221 and the collision bracket 100. Therefore, the rotation prevention member 600 may be rigid enough not to be broken by vibration or impact during any normal driving situation, and may be broken by an external shock from a head-on vehicle collision. Due to the presence of the rotation prevention member 600, the rotation of the rotating member 200 may be prevented during normal driving situations to restrain the rotation of the pedal arm 300.

The pedal arm 300 may be rotatably mounted on the supporting bracket 400. More specifically, a third insertion aperture 330 may be formed on the pedal arm 300, and a hinge axial member 700, inserted into a pair of fourth insertion apertures 413 and 423 formed on the first supporting bracket member 410 and the second supporting bracket member 420, respectively, may also be inserted into the third insertion aperture 330. As a result, the pedal arm 300 may be rotatably mounted on the supporting racket 400. The rotation of the pedal arm 300 may be restrained or released by the rotating member 200. In other words, in response to the rotation prevention member 600 being broken upon a head-on vehicle collision, the rotating member 200 may rotate to release the second arm 200 of the rotating member 200 from the insertion groove 320 of the pedal arm 300. As a result, the rotation of the pedal arm 300 may be released. Otherwise, the rotation of the pedal arm 300 may continue to be restrained.

Figure 4:
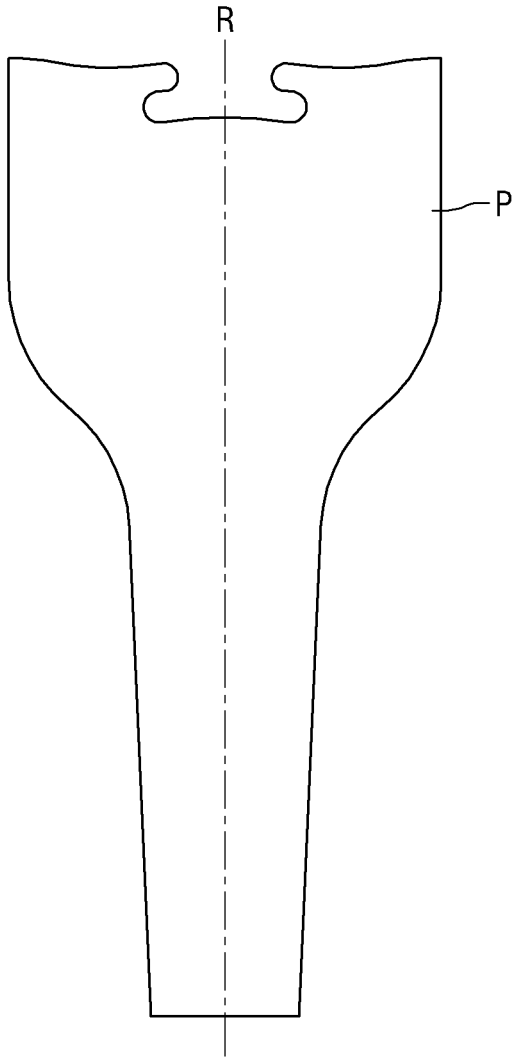
FIG. 4 is an exemplary view illustrating a plate for forming the pedal arm of FIG. 3 according to an exemplary embodiment of the present invention.

In the exemplary embodiment of FIGS. 1 to 3, the pedal arm 300 may be formed in a tubular shape with a cavity 300*a* formed in a lengthwise direction thereof. By forming the cavity 300*a* in the pedal arm 300, the overall weigh and the manufacturing cost, of a vehicle pedal may be reduced, and the rotation of the pedal arm 300 may be prevented from being hindered by the weight of the pedal arm 300. In addition, the cavity 300*a* may be formed in the pedal arm 300 by bending a plate P, formed of a metal material, in about half along a predetermined reference line R, bonding both sides of the plate P together through welding, and processing the plate P into a desired shape (through, for example, cutting or bending), as illustrated in FIG. 4. Further, a stepped portion 224 may be formed on the rotating member 220 between the second arm 222 and the third arm 223, and a part of the stepped portion 224 may be inserted into the cavity 600*a* due to the step difference with the rest of the stepped portion 224. In addition, the rotating member 200 may be disposed to contact one end of the pedal arm 300.

According to the exemplary embodiment of FIGS. 1 to 3, the weight of a vehicle pedal may be reduced by forming the cavity 300*a* in the pedal arm 300, and by forming the rotating member 200 of a light-weight material such as a plastic material. To compensate for any decrease in the rigidity of a vehicle pedal due to the rotating member 200 being formed of a light-weight material, the rotating member 200 may also include a reinforcing member 250 formed of a reinforcing material such as a metal material.

Figure 5:
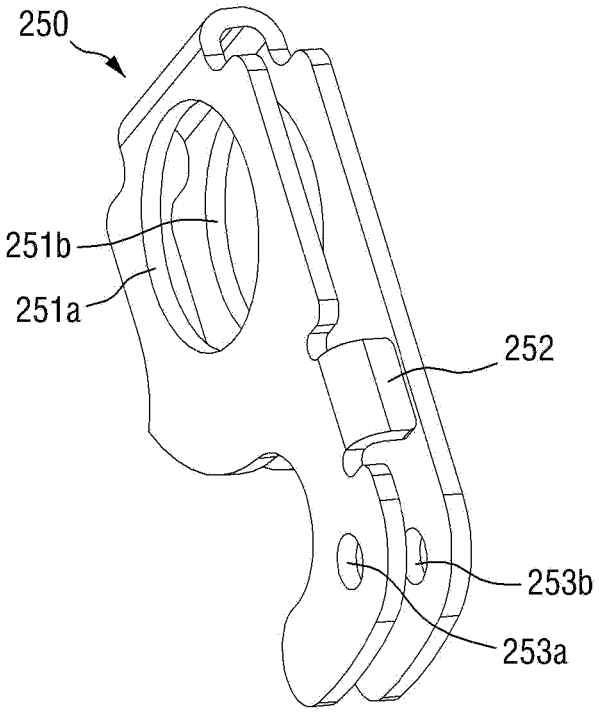
FIG. 5 is an exemplary view illustrating a reinforcing member according to an exemplary embodiment.
Figure 6:
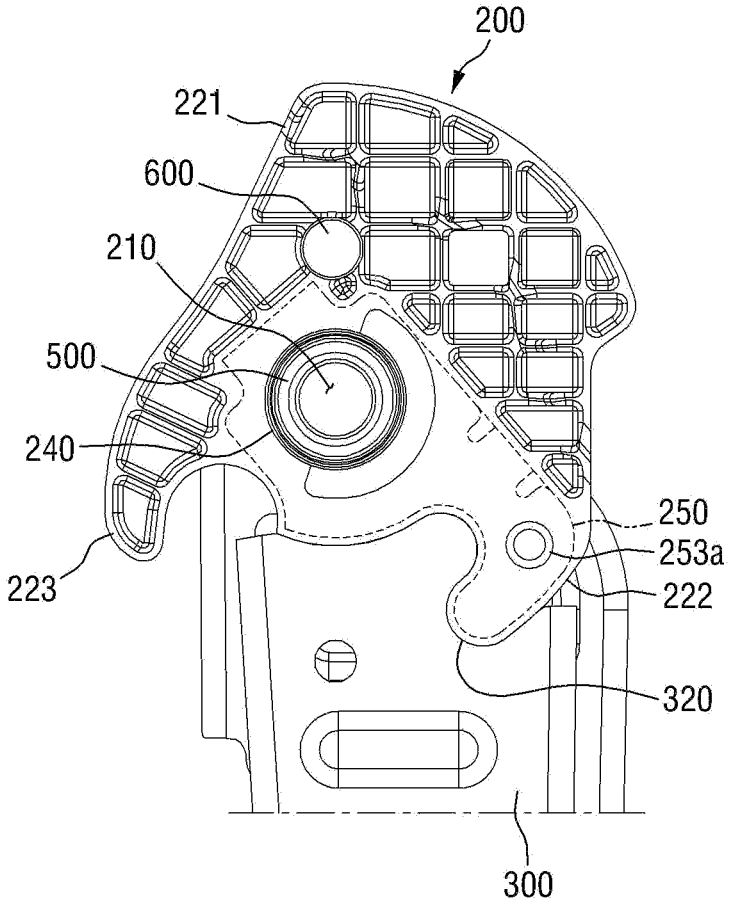
FIG. 6 is an exemplary view illustrating the reinforcing member of FIG. 5 installed in a rotating member according to an exemplary embodiment.

FIG. 5 is an exemplary view illustrating a reinforcing member according to an exemplary embodiment, and FIG. 6 is an exemplary view illustrating the reinforcing member of FIG. 5 installed in a rotating member according to an exemplary embodiment. For convenience, FIG. 6 only illustrates a rotating member and a pedal arm. Referring to FIGS. 5 and 6, a reinforcing member 250 may be inserted into the rotating member 200. The reinforcing member 250 may be formed first, and then, the rotating member 200 may be formed by injection molding, i.e., by inserting the reinforcing member 250 into a mold and injecting a resin into the mold.

The reinforcing member 250 may include a pair of second coupling apertures 251*a* and 251*b*. The reinforcing member 250 may be bent in half between the second coupling apertures 251*a* and 251*b* to allow both sides of the reinforcing member 250 to face each other. The second coupling apertures 251*a* and 251*b* of the reinforcing member 250 may correspond to the first coupling aperture 210 of the rotating member 200. Since the pedal arm 300 may include the cavity 300*a* therein, the reinforcing member 250 may be bent in about half to space both sides of the reinforcing member 250 by a distance that corresponds to the diameter of the cavity 300*a* in one direction. Accordingly, the reinforcing member 250 may effectively reinforce the rotating member 200 against the force applied between the rotating member 200 and the pedal arm 300.

A spacing adjustment protrusion 252 may be formed on at least one side of the reinforcing member 250. Due to the presence of the spacing adjustment protrusion 252, the reinforcing member 250 may be bent to space both sides of the reinforcing member 250 by a distance that corresponds to the length of the spacing adjustment protrusion 252, i.e., a distance that corresponds to the diameter of the cavity 300*a* of the pedal arm 300. The length of the spacing adjustment protrusion 252 may vary based on the diameter of the cavity 300 of the pedal arm 300, and thus, both sides of the reinforcing member 250 may be spaced by the distance that corresponds to the diameter of the cavity 300*a* of the pedal arm 300.

The second coupling apertures 251*a* and 251*b* may be disposed to correspond to the first coupling aperture 210 of the rotating member 200. In addition, in response to the rotating member 200 including the reinforcing member 250, the inner pipe 240 may be disposed in first coupling aperture 210, and in each of the second coupling apertures 251*a* and 251*b*, to allow the rotating member 200 to more smoothly rotate through the pipe hinge 500. A plurality of alignment grooves 253*a* and 253*b* may be formed at either end of the reinforcing member 250. The alignment grooves 253*a* and 253*b* may be used to properly align the reinforcing member 250 for a bending process or for an injection molding process for forming the rotating member 200.

As illustrated in FIG. 6, the reinforcing member 250 may be a predetermined distance apart from the end of the pedal arm 300 for error tolerance in consideration that the fabrication of the reinforcing member 250 using a metal material substantially difficult. As a result, it may be possible to prevent the rotation of the rotating member 200 or the pedal arm 300 from being adversely affected by the reinforcing member 250. When no error (e.g. minimal error) is to occur during the formation of the reinforcing member 250, the reinforcing member 250 may be formed to contact the pedal arm 300.

In the apparatus 1, the cavity 300*a* may be formed in the pedal arm 300, and the rotating member 200 may be formed of a plastic material, which is substantially light in weight. Accordingly, it may be possible to reduce the overall weight of a vehicle pedal and to reinforce the vehicle pedal with the use of the reinforcing member 250, if necessary. In the exemplary embodiment of FIGS. 1 to 6, the cavity 300*a* may be formed in the pedal arm 300, and the reinforcing member 250 may be bent to space both sides of the reinforcing member 250 by a distance that corresponds to the diameter of the cavity 300*a* of the pedal arm 300. Alternatively, the reinforcing member 250 may be formed to be firmly attached to one end of the pedal arm 300, i.e., at the upper end of the pedal arm 300, along the outer circumference of the cavity 300*a*.

Figure 7:
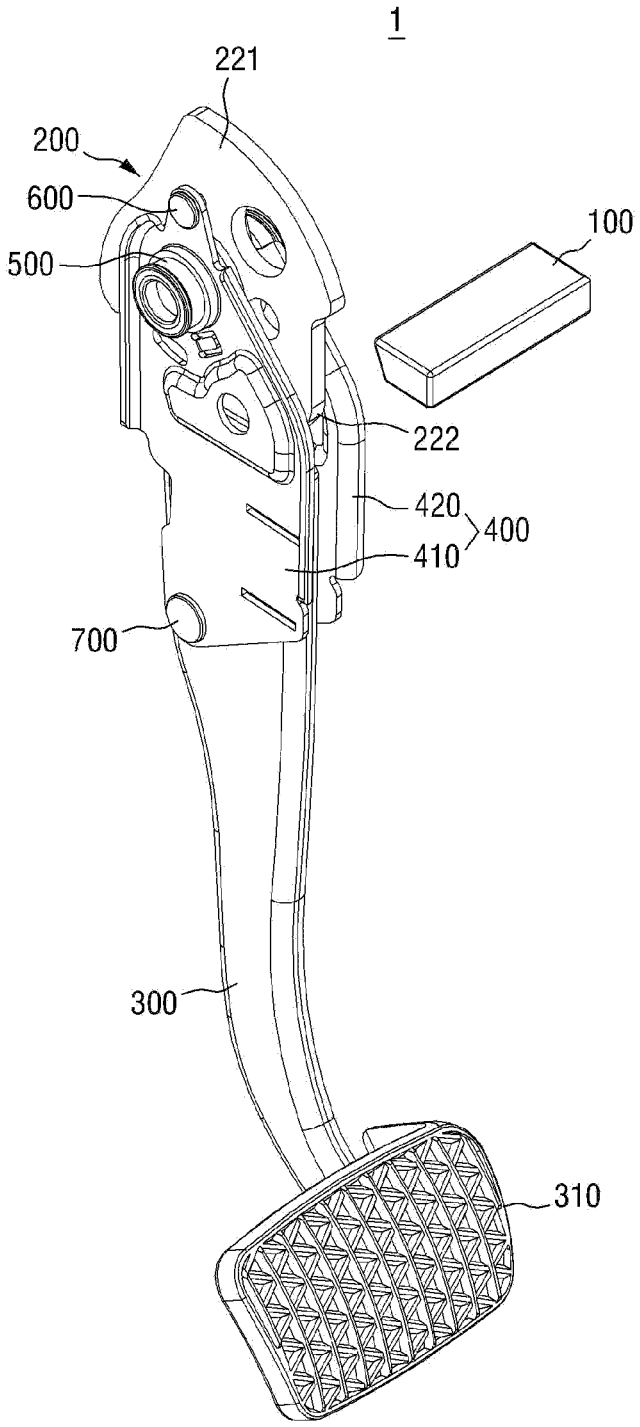
FIG. 7 is an exemplary view illustrating an apparatus for preventing a vehicle pedal from being pushed rearward, according to another exemplary embodiment.
Figure 8:
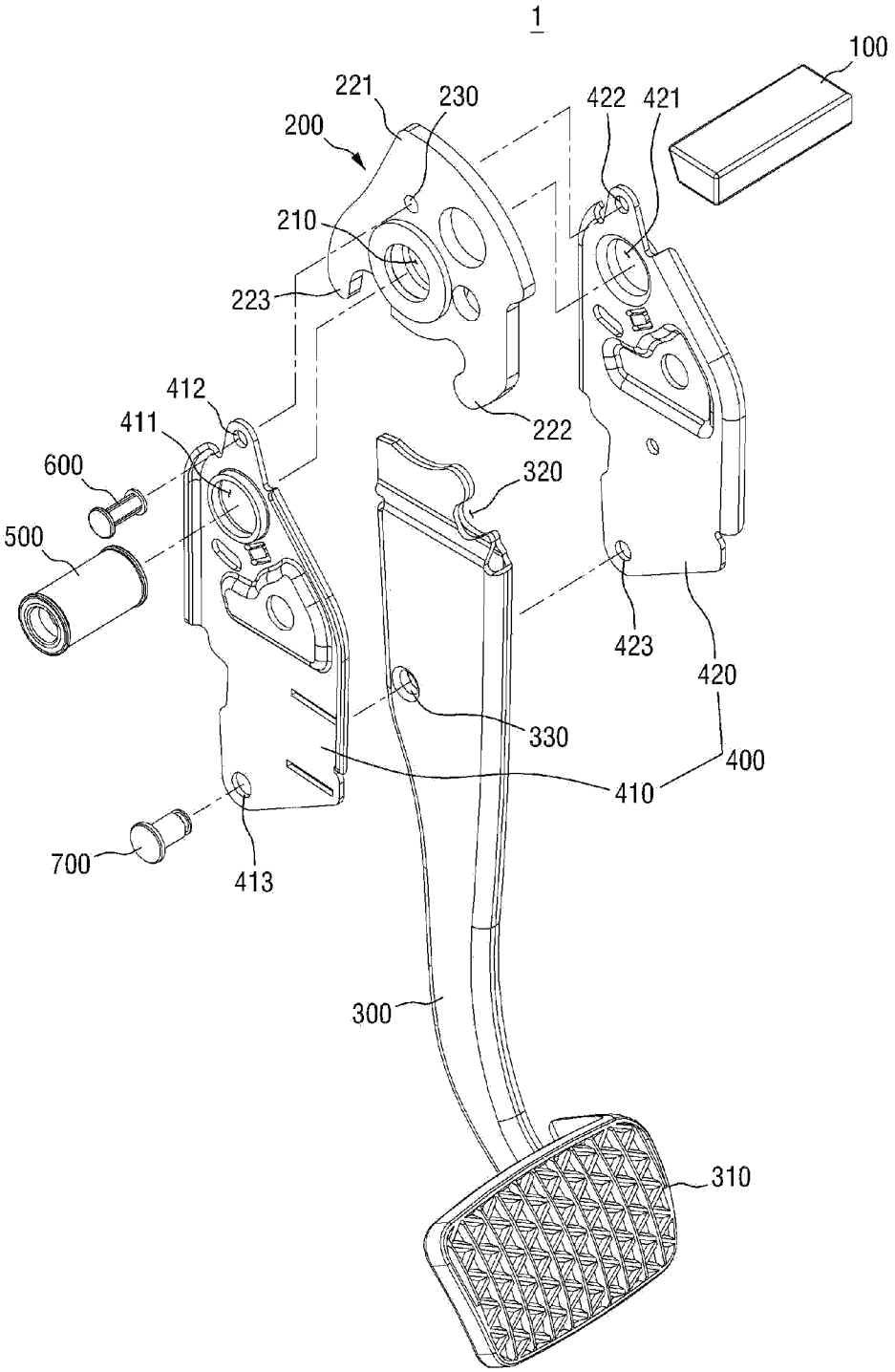
FIG. 8 is an exemplary detailed view illustrating the apparatus of FIG. 7 according to an exemplary embodiment of the present invention.
Figure 9:
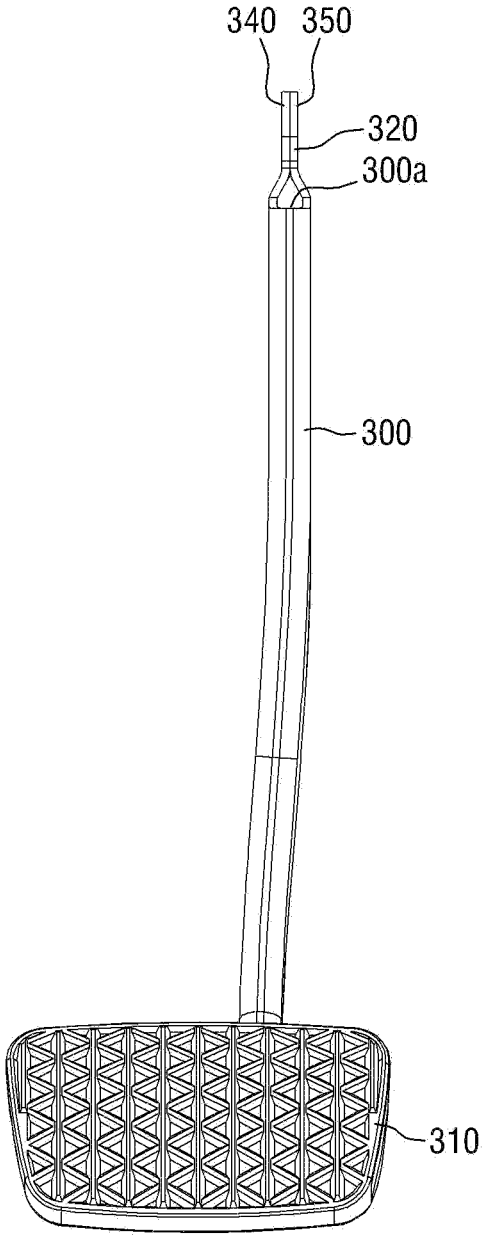
FIGS. 9 and 10 are exemplary views illustrating a pedal arm according to another exemplary embodiment.
Figure 10:
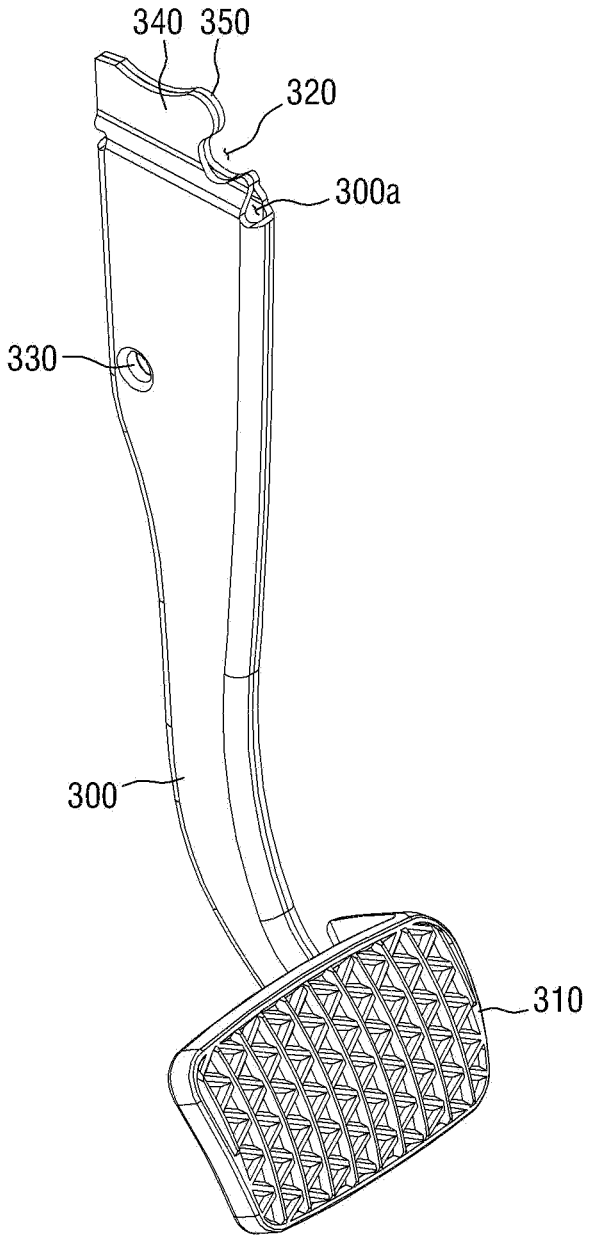

FIG. 7 is an exemplary view illustrating an apparatus for preventing a vehicle pedal from being pushed rearward, according to another exemplary embodiment, FIG. 8 is an exemplary detailed view illustrating the apparatus of FIG. 7, and FIGS. 9 and 10 are exemplary views illustrating a pedal arm according to another embodiment. In FIGS. 1 to 10, like reference numerals indicate like elements. Referring to FIGS. 7 to 10, an apparatus 1 for preventing a vehicle pedal from being pushed rearward, like the counterpart of FIGS. 1 to 4, may include a collision bracket 100, a rotating member 200, a pedal arm 300 and a supporting bracket 400. The collision bracket 100, the rotating member 200, the pedal arm 300 and the supporting bracket may perform the same functions as their respective counterparts of FIGS. 1 to 4, and thus, detailed descriptions of the functions thereof will be omitted.

The collision bracket 100 may be disposed on one side of an upper end of the pedal arm 300 and may be a predetermined distance apart from the pedal arm 300. The rotating member 200 and the pedal arm 300 may be rotatably mounted on the supporting bracket 400. The supporting bracket 400 may include a first supporting bracket member 410 and a second supporting bracket member 420 disposed on either side of the pedal arm 300.

The rotating member 200, like its counterpart of FIGS. 1 to 4, may include a first coupling aperture 210, a first arm 221, a second arm 222 and a third arm 223. A pipe hinge 500, which may be inserted into a first supporting aperture 411 and a second supporting aperture 421 formed on the first supporting bracket member 410 and the second supporting bracket member 420, respectively, may also be inserted into the first coupling aperture 210. As a result, the rotating member 200 may be rotatably mounted on the supporting bracket 400. In response to the pedal arm 300, connected to a master vac (not illustrated) on the opposite side of a dash panel (not illustrated), being pushed rearward along with the rotating member 200 upon a head-on vehicle collision, the first arm 221 may collide with the collision bracket 100, one end of the second arm 222 may be inserted into an insertion groove 320, formed at the upper end of the pedal arm 300, and the third arm 223 may strike one end of the pedal arm 300 in response to the rotating member 200 rotating due to the collision between the first arm 221 and the collision bracket 100.

A first insertion aperture 230 may be formed on the rotating member 200, and a rotation prevention member 600 may be inserted into the first insertion aperture 230 to prevent the rotation of the rotating member 200 during normal driving situations (e.g., when a collision does not occur). A pair of second insertion apertures 412 and 422 may be formed on the first supporting bracket member 410 and the second supporting bracket member 420, respectively, and both ends of the rotation prevention member 600 may be inserted into the second insertion apertures 412 and 422, respectively. A third coupling aperture 330 may be formed on the pedal arm 300, and a hinge axial member 700, which may be inserted into a pair of fourth insertion apertures 413 and 423 formed on the first supporting bracket member 410 and the second supporting bracket member 420, respectively, may also be inserted into the third insertion aperture 330. As a result, the pedal arm 300 may be rotatably mounted on the supporting racket 400.

The pedal arm 300, like its counterpart of FIGS. 1 to 4, may include a cavity 300*a* formed in a tubular shape in the lengthwise direction of the pedal arm 300. The pedal arm 300 may be formed to be firmly attached to the rotating member 200 along the outer circumference of the cavity 300*a*. In addition, a pair of extended portions 340 and 350 may be formed to extend from a pair of opposite outer circumferential sides of the pedal arm 300 with the cavity 300*a* and may be compressed against each other to be firmly attached to each other. In this example, the insertion groove 320 may be formed on parts of the extended portions 340 and 350 that are compressed against each other.

In response to the rotating member 200 being formed to be firmly attached to the pedal arm 300 along the outer circumference of the cavity 300*a* of the pedal arm 300, the rotating member 200 may have a greater thickness than the pedal arm 300, and may thus may more stably restrain or release the rotation of the pedal arm 300, and a reinforcing member 250 may be formed in one body with the rotating member 200 without a requirement of a bending process that is needed in the exemplary embodiment of FIGS. 1 to 6.

In the previous exemplary embodiments, the cavity 300*a* may be formed in the pedal arm 300, the reinforcing member 250 may be included in the rotating member 200, and/or one end of the pedal arm 300 with the cavity 300*a* may be compressed. However, the present inventive concept is not limited to the previous embodiments, and some of the features from the previous embodiments may be combined and used together as long as no design problems are caused.

Figure 11:
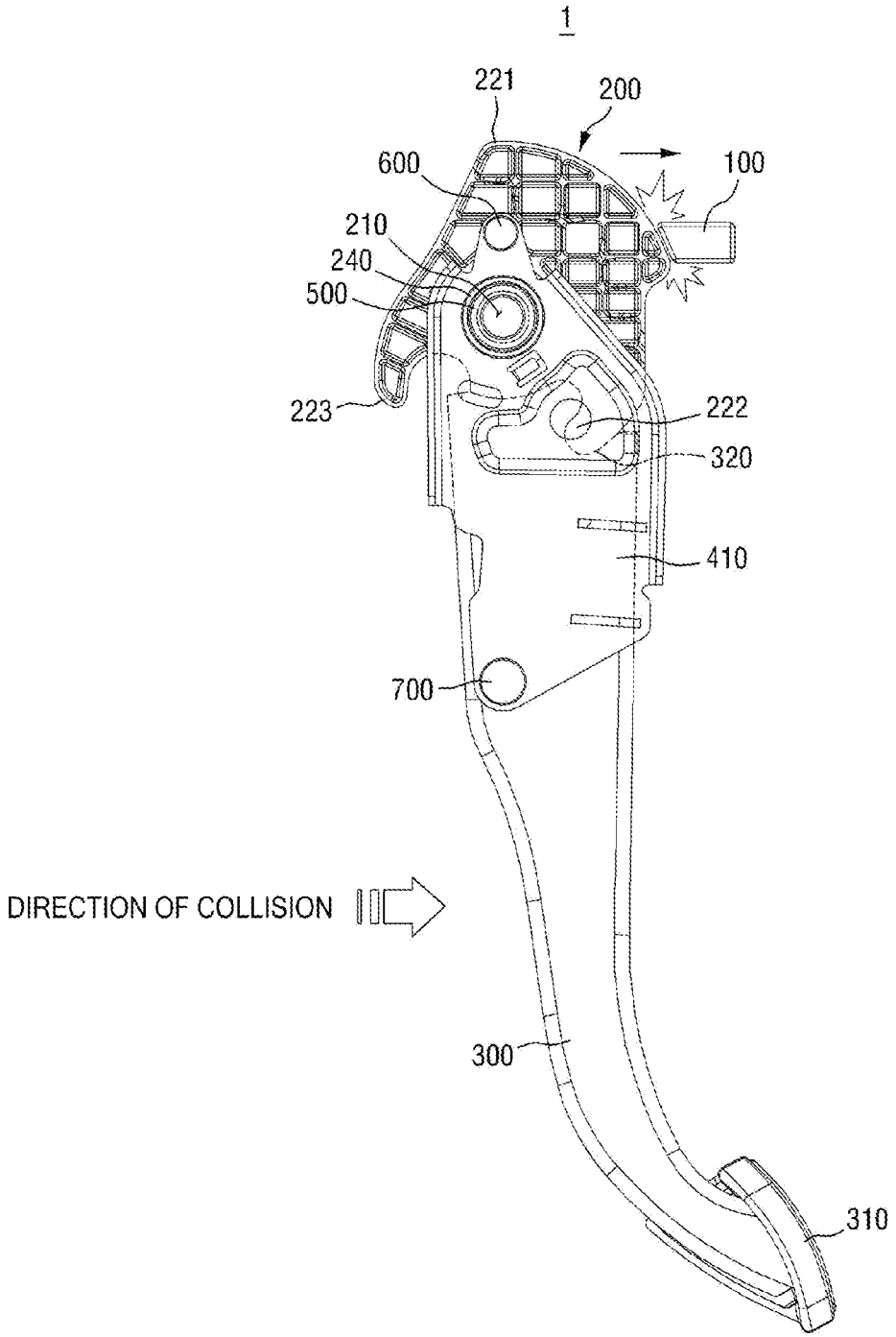
FIGS. 11 to 13 are exemplary side views illustrating the operation of an apparatus for preventing a vehicle pedal from being pushed rearward, according to exemplary embodiments.
Figure 12:
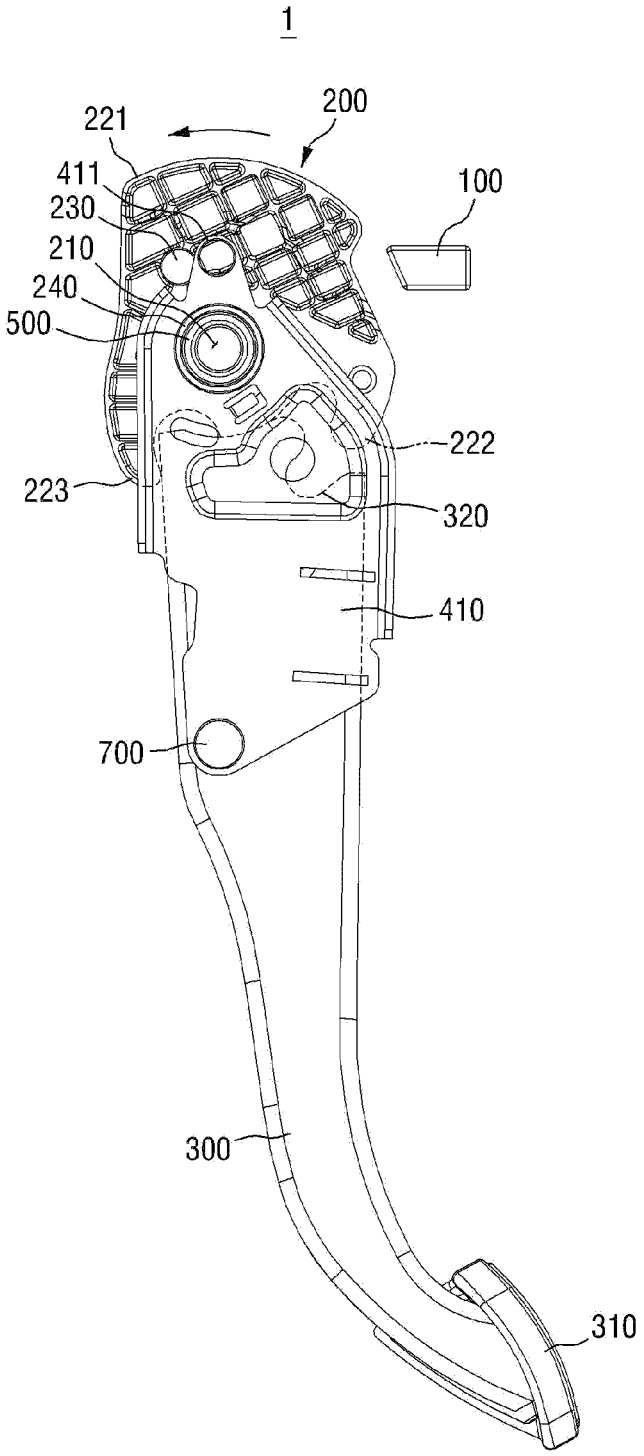
Figure 13:
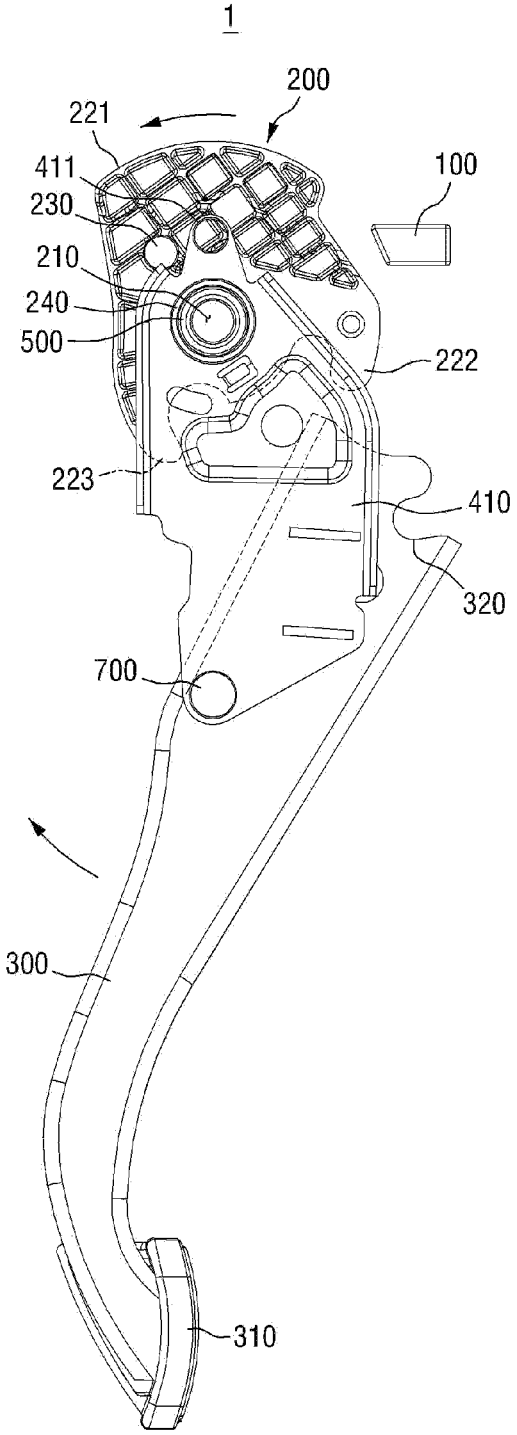

FIGS. 11 to 13 are exemplary side views illustrating the operation of an apparatus for preventing a vehicle pedal from being pushed rearward, according to exemplary embodiments. The operation of an apparatus for preventing a vehicle pedal from being pushed rearward, according to exemplary embodiments will hereinafter be described, taking the apparatus 1 of FIGS. 1 and 2 as an example, but the description that follows may also be applicable to the apparatus 1 of FIGS. 7 and 8.

Referring to FIG. 11, in response to the occurrence of a head-on vehicle collision, the pedal arm 300 may be pushed rearward toward the inside of the vehicle, as indicated by an arrow, and the first arm 221 of the rotating member 200 may collide with the collision bracket 100. The location of the collision bracket 100 may be fixed. In response to the first arm 221 colliding with the collision bracket 100, the rotation prevention member 600 may be broken due to the impact of the collision, and the rotating member 200 may be released from the rotation prevention member 600, and may thus become rotatable.

In response to the pedal arm 300 being pushed further rearward even after the rotation prevention member 600 is broken, the rotating member 200 may rotate due to the force applied to the first arm 221 by the collision between the first arm 221 and the collision bracket 100. As a result, the second arm 222 may be released from the insertion groove 320 of the pedal arm 300, and the third arm 223 may strike (e.g., contact, hit) one end of the pedal arm 300. The pedal arm 300 may rotate in a direction in which the pedal arm 300 is struck by the third arm 223. As a result, the pedal arm 300 may be released and may begin to rotate in an opposite direction to the direction of the vehicle collision. As a result, the pedal arm 300 may be prevented from being pushed further rearward, i.e., toward the inside of the vehicle.

Although exemplary embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An apparatus for preventing a vehicle pedal from being pushed rearward, comprising:

a collision bracket fixedly installed on a dash panel;

a pedal arm formed by bending a plate along a predetermined reference line to form a cavity in a lengthwise direction of the pedal arm;

a rotating member disposed at an end of the pedal arm and configured to strike one side of the pedal arm upon colliding with the collision bracket to rotate in a direction toward the inside of a vehicle and release the pedal arm;

a supporting bracket rotatably supporting the pedal arm and the rotating member; and a reinforcing member included in the rotating member and configured to reinforce the rotating member, wherein the rotating member includes a coupling aperture upon which the supporting bracket is hinged and a plurality of arms oriented in different directions with respect to the coupling aperture, and wherein the reinforcing member includes a plurality of coupling apertures and is bent between the plurality of coupling apertures to cause both sides of the reinforcing member to face each other.

2. The apparatus of claim 1, wherein the rotating member is formed of a plastic material.

3. The apparatus of claim 1, wherein the reinforcing member is formed of a metal material.

4. The apparatus of claim 1, wherein the plurality of coupling apertures are disposed to correspond to a rotational axis of the rotating member.

5. The apparatus of claim 1, wherein the reinforcing member includes a spacing adjustment protrusion formed on at least one of side of the reinforcing member, wherein the spacing adjustment protrusion is configured to adjust the gap between both sides of the reinforcing member.

6. The apparatus of claim 5, wherein the spacing adjustment protrusion has a length that corresponds to the diameter of the cavity of the pedal arm.

7. The apparatus of claim 1, wherein the reinforcing member is a predetermined distance apart from the end of the pedal arm.

8. The apparatus of claim 1, wherein the pedal arm includes one or more extended portions formed at the end of the pedal arm, which is adjacent to the rotating member, wherein the extended portions extend from the outer circumference of the pedal arm and are attached to each other.

9. The apparatus of claim 1, further comprising:

an inner pipe disposed on the inside of the coupling aperture of the rotating member and on the outside of a pipe hinge upon which the supporting bracket is hinged.

10. The apparatus of claim 1, further comprising:

a rotation prevention member inserted into the rotating member to prevent the rotation of the rotating member.

11. The apparatus of claim 10, wherein the rotation prevention member includes at least one end inserted into the supporting bracket.

12. The apparatus of claim 10, wherein the rotation prevention member is formed of a plastic material and is configured to break for the rotating member to be rotatable in response to an external shock with a predetermined magnitude or greater being applied.

13. An apparatus for preventing a vehicle pedal from being pushed rearward, comprising:

a collision bracket fixedly installed on a dash panel;

a pedal arm formed by bending a plate along a predetermined reference line to form a cavity in a lengthwise direction of the pedal arm;

a rotating member disposed at an end of the pedal arm and configured to strike one side of the pedal arm upon colliding with the collision bracket to rotate in a direction toward the inside of a vehicle and release the pedal arm;

a supporting bracket rotatably supporting the pedal arm and the rotating member; and a reinforcing member included in the rotating member and configured to reinforce the rotating member, wherein the rotating member includes a coupling aperture upon which the supporting bracket is hinged and a plurality of arms oriented in different directions with respect to the coupling aperture, and wherein one end of at least one arm of the rotating member is combined with one end of the pedal arm.

* * * * *